US006387022B1

(12) United States Patent
Smith

(10) Patent No.: US 6,387,022 B1
(45) Date of Patent: May 14, 2002

(54) ADJUSTABLE WEIGHT MEDICINE BALL WITH HANDLE

(76) Inventor: Robert S. Smith, 1203 Emory St., San Jose, CA (US) 95126

( * ) Notice: Subject to any disclaimer, the term of this patent is extended or adjusted under 35 U.S.C. 154(b) by 0 days.

(21) Appl. No.: 09/649,411

(22) Filed: Aug. 26, 2000

Related U.S. Application Data

(60) Provisional application No. 60/150,929, filed on Aug. 26, 1999.

(51) Int. Cl.[7] ..... A63B 21/00
(52) U.S. Cl. ..... 482/106; 482/108
(58) Field of Search ..... 482/92, 93, 106, 482/108

(56) References Cited

FOREIGN PATENT DOCUMENTS

| | | | | |
|---|---|---|---|---|
| SU | 001738294 | * | 6/1992 | ..... 482/93 |
| SU | 001755829 | * | 8/1992 | ..... 482/93 |
| SU | 001759440 | * | 9/1992 | ..... 482/93 |
| SU | 1409295 | * | 7/1998 | ..... 482/93 |

* cited by examiner

*Primary Examiner*—Glenn E. Richman
(74) *Attorney, Agent, or Firm*—Robert Samuel Smith

(57) ABSTRACT

An adjustable weight ball for exercising having a cavity where an adjustable number of weights can be secured. There is included a cap that firs over an opening with a handle on one side of the cap and a threaded stem extending away from an opposite side. Barbell weights having a central aperture are mountable on the stem. The free end of the stem is screwed into a nut secured on the floor of the cavity.

5 Claims, 3 Drawing Sheets

ADJUSTABLE WEIGHT MEDICINE BALL WITH HANDLE

CROSS REFERENCE

This application is a non provisional application of provisional application No. 60/150,929, filed on Aug. 26, 1999 from which priority is claimed.

FIELD OF THE INVENTION

This invention relates to medicine ball exercisers and particularly to a medicine ball having a handle and in which the weight is changeable by adding or subtracting barbell weights.

BACKGROUND

The medicine ball is a device that has enjoyed more than a century. of popularity. The typical medicine ball is generally larger than 10 inches diameter and has a leather upholstered surface. In recent years other versions of the medicine bail have appeared in which the balls have handles and are filled with various amounts of sand and shot. These balls are sold having weights in the range from 2 pounds up to about 35 pounds. These balls are expense, ranging in price from $ 30.00 for a two pond ball upwards to $ 100.00 for the heavier ball. There is also a demand for heavier balls up to 70 pounds. The typical athlete in training using the balls has a set, usually two balls (one for each hand) in each of a range of weights—6, 8, 12, 15, 20, 25 pounds.

Several problems characterize the use of these balls. The athlete must have a large number of balls. As his/her strength increases, he needs heavier and heavier balls and he wants to increase the weight in small increments. Storage and expense is therefore a problem.

SUMMARY OF THE INVENTION

It is an object of t his invention to provide a medicine ball with a handle that enables an athlete to grasp the ball in one or both hands or a pair of balls held in both hands for performing exercises.

It is another object that the ball be throwable without damage to ball or the surrounding floor or walls.

It is a further object that an array of weights be storable in the ball so that .the weight of the ball can be changed in small increments as required.

This invention is directed toward a solid ball having an open cavity into which the weights of a handle/weight assembly is inserted and releasably secured. The handle on the other end of the stem is accessible to the athlete. The handle/weight assembly includes a cap (disk) having a handle on one side and a threaded stem exteinding perpendicularly from the disk on the other side. Barbell plates, being round disks with a center hole, are mounted on the disk by passing the threaded stem through the holes and securing the disks with a nut on each side of the stack of disks. The .handle disk assembly is secured with the stack of weights inside the ball by turning the handle and screwing the end of the stem opposite the handle into a nut secured on the floor of the cylindrical cavity.

DESCRIPTION OF A BEST MODE

Figure 1:
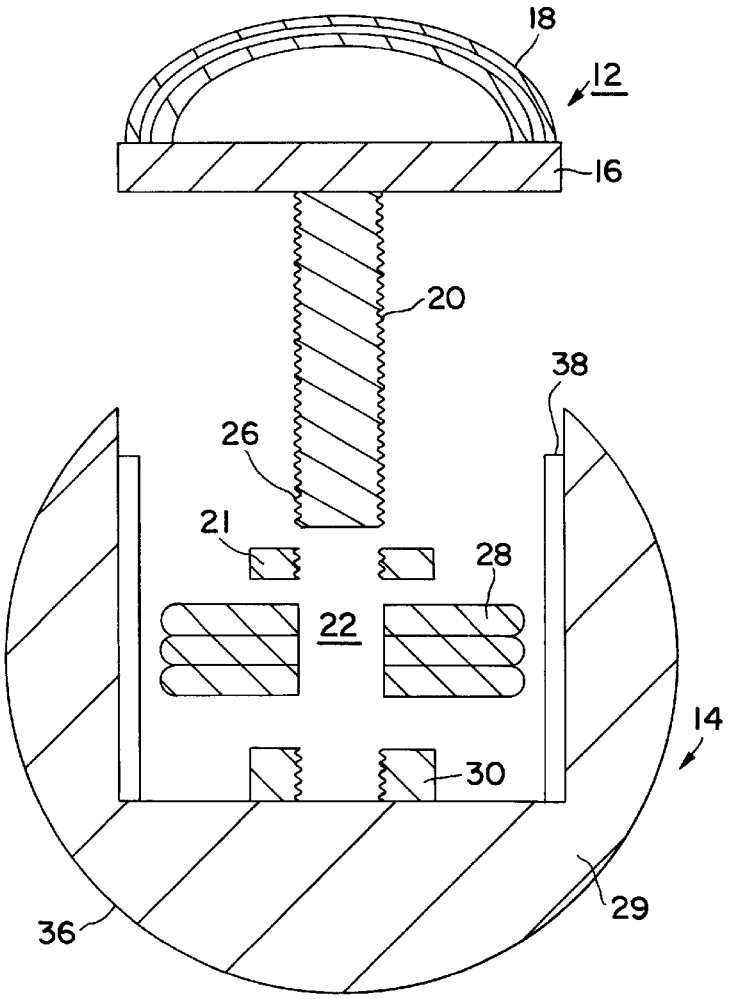
FIG. 1 is a sectional view of the invention.
Figure 2:
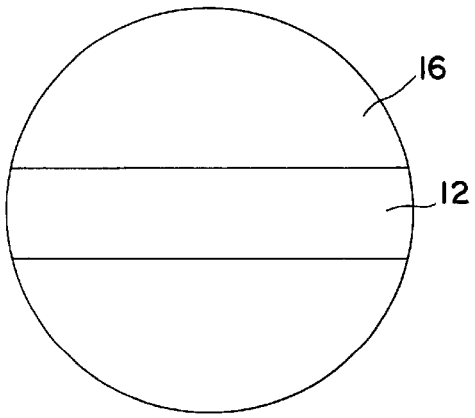
FIG. 2 is a top view of the invention showing the handle.

Turning now to a discussion of the drawings, FIG. 1 is a sectional view of the adjustable weight power ball of this invention including the handle section 12 and the ball section. The handle section 12 includes a flat cap 16 and a handle 18 as shown in the top view of FIG. 2. A threaded stem 20 has one end firmly secured perpendicular to the cap 16. and may be extended down through the central apertures 22 of a stack of disk weights 28 enabling that the lower end 26 of stem 20 to be screwed (by turning handle 12 ) into a nut 30 that is firmly anchored into the bottom wall 33 of the shell 32. The ball section 14 is a solid ball. In another embodiment, the ball section is preferably an integral cast shell having the cylindrical core section 34 inside the outer spherical section 36.

In one embodiment, a shoulder 38 is formed where the ball section 14 is meets the handle section 12.

In one embodiment, a flange 21 screwed onto stem 20 is prepositioned on stem 20 so that the stack of disk weights are confined on the stem 20 between the bottom wall 33 and the flange The region 29 bounded by the inside surface of the ball and the outside surface of the core is preferably filled with an appropriate fill such as sand and or shot or foam..

Figure 3:
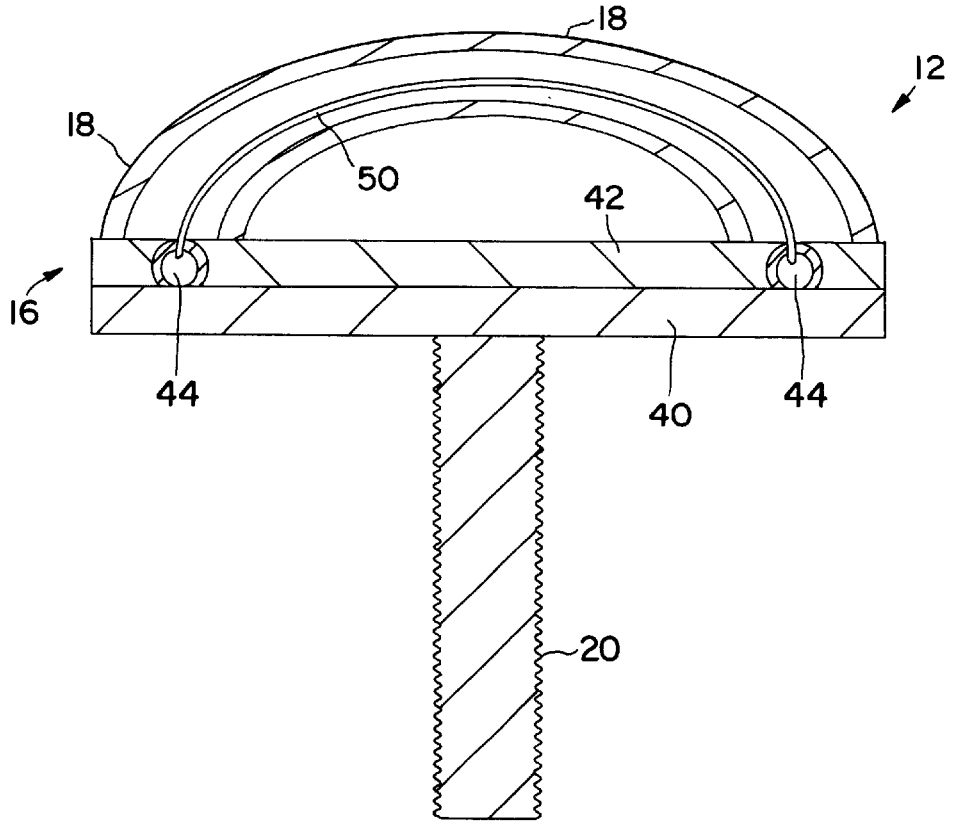
FIG. 3 shows details of the handle.

As shown in FIG. 3., the cap 16 is a composite of a metal plate 40 laminated to a soft pad 42. and has ears (not shown) which extend into flexible tubular handle 18.

A steel cable 50 is threaded through the tubular handle 18 Each end of cable 50 is welded or otherwise firmly secured to a respective one of ears 44.

Figure 4:
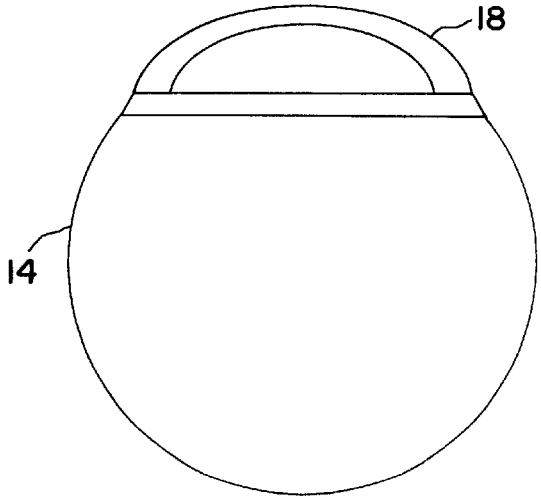
FIG. 4 is a side view of the ball assembly.

FIG. 4 shows the assembled ball with a selected amount of disk weights inside and ready for exercise by picking the ball up by handle 18.

Figure 5:
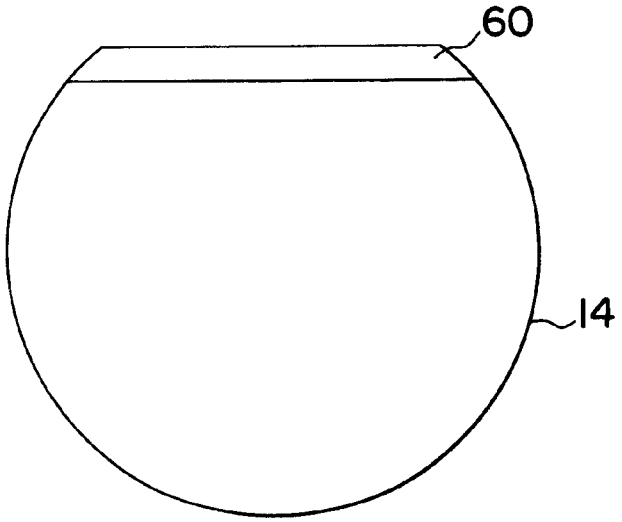
FIG. 5 shows the handle replaced by a lid

Alternative to picking the ball up by handle 18, FIG. 5 shows the medicine ball with the handle replaced by a round cap 60 that has no handle but does have the threaded sem (not shown) and which is screwed into the nut in the floor of the cylindrical core 34.

The closed region bounded by the surface of the cavity facing the inside surface of the spherical shell may-be filled with any one of a number of materials including foam, sand or shot t.

An exercise device has been described comprising a block of a selected medium and having a cavity in the block where an array of weights are installed.

Variations and modifications may be contemplated after reading the specification and studying the drawings which are within the scope of the invention.

Figure 6:
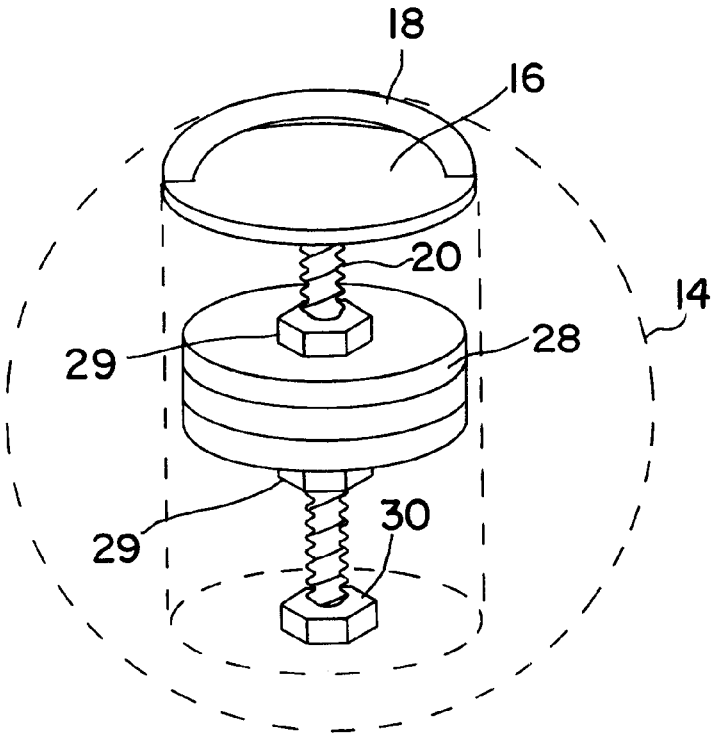
FIG. 6 shows an arrangement for securing/releasing the array of weights.

For example, FIG. 6 shows the array of weights 28 secured on the stem 20 by nuts 29.

The ball with cavity may be a homogeneous material such as a rubber or resinous casting.

The outside shell may a cylinder rather than a ball. The inside cavity has a rectangular cross section.

I therefore wish to define the scope of my invention by the appended claims.

I claim:

1. A device for exercising which comprises:

a spherical block of a medium having an inner cylindrical cavity;

said inner cylindrical cavity having an opening on one end of said cylindric cavity and opening on a surface of said spherical block whereby access to said cylindrical cavity is provided;

said inner cylindrical cavity having a floor on another end of said cavity opposite said opening;

a cap dimensioned to fit over said opening;

a handle on one side of said cap;

a threaded stem having one end secured to another side of said cap and extending perpendicularly away from said another side;

a stack of at least one disk weight, insertable through said hole into said cavity;

each disk weight having a central aperture providing that said stack is mountable on said stem;

one nut screwed onto said stem on one side of said stack and another nut screwed onto said stem on an opposite side of said stack whereby said stack is releasably secured onto said stem;

means for releasably securing said stem in said cavity providing that a user is enabled to select a quantity of weights of said array for mounting on said stem.

2. The device of claim 1 wherein said means for releasably securing said array comprises:

fastening means for releasably securing another end of said stem opposite said cap to a floor of said cavity providing that a user is enabled to grasp said handle, withdraw said stem and said array of weights on said stem, from said cavity change said array of weights and resecure said changed array of weights for exercise purposes.

3. The device of claim 1 wherein said block comprises:

a shell integrally formed as a ball having an opening on its surface formed by said cylindrical cavity inside said ball wherein an interior region is formed by said shell between a surface of said cylindrical cavity and a spherical surface of said ball;

a medium filling said region.

4. The device of claim 3 wherein said medium is at least one of air, sand and shot.

5. The device of claim 1 wherein each weight of said array of weights is a disk having an aperture through its center.

* * * * *